US007273363B1

(12) United States Patent
Sun et al.

(10) Patent No.: US 7,273,363 B1
(45) Date of Patent: Sep. 25, 2007

(54) SCROLL COMPRESSOR WITH SLIDER BLOCK HAVING RECESS

(75) Inventors: Zili Sun, Arkadelphia, AR (US); Tapesh Patel, Hotsprings, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 11/593,810

(22) Filed: Nov. 7, 2006

(51) Int. Cl.
*F01C 1/02* (2006.01)
*F03C 2/00* (2006.01)
*F04C 2/00* (2006.01)

(52) U.S. Cl. ..... 418/55.5; 418/14; 418/55.1; 418/57

(58) Field of Classification Search ..... 418/14, 418/55.1–55.6, 57
See application file for complete search history.

(56) References Cited

U.S. PATENT DOCUMENTS 6,082,495 A * 7/2000 Steinbarger et al. ..... 418/55.6
6,106,251 A * 8/2000 Monnier et al. ..... 418/14
6,203,300 B1 * 3/2001 Williams et al. ..... 418/55.5
6,471,499 B1 * 10/2002 Sun ..... 418/55.5
6,585,502 B2 * 7/2003 Fenocchi ..... 418/55.5

* cited by examiner

*Primary Examiner*—Theresa Trieu
(74) *Attorney, Agent, or Firm*—Carlson, Gaskey & Olds

(57) ABSTRACT

A slider block for a scroll compressor has a recess formed in a wall between a flat portion on the outer surface and a chamfer formed on the inner surface. The recess eliminates a high stress area of the prior art, and reduces cracks originating from this area of the slider block.

6 Claims, 2 Drawing Sheets

SCROLL COMPRESSOR WITH SLIDER BLOCK HAVING RECESS

BACKGROUND OF THE INVENTION

The present invention relates generally to a scroll compressor having a slider block, wherein the slider block has a recess extending from one end of the slider block between a chamfer on an inner bore and a flat portion on an outer bore of the slider block.

Scroll compressors are becoming widely utilized in refrigerant compression applications. In a scroll compressor a first scroll member has a generally spiral wrap extending from a base. A second scroll member has its own wrap which interfits with the spiral wrap of the first scroll member. The second scroll member is caused to orbit relative to the first scroll member to entrap and then compress a refrigerant.

In one type of scroll compressor, the drive mechanism for causing the scroll member to orbit includes a drive shaft driven to rotate, and having an eccentric pin extending upwardly into a slider block. The slider block is received within a rearwardly extending boss in the orbiting scroll. The eccentric pin drives the orbiting scroll through the slider block. A chamfer formed on the inner bore of the slider block allows the slider block to be seated against the driveshaft.

A generally flat portion is formed on the outer surface of the slider block to allow oil to pass along the slider block and enter the boss. The wall of the slider block is thin between the flat portion on the outer surface and the chamfer on the inner bore. The thin wall is undesirably prone to cracking.

Accordingly, an arrangement to prevent cracking on the wall of the slider block between the flat portion and the chamfer is desired.

SUMMARY OF THE INVENTION

In the disclosed embodiment of this invention, a slider block for a scroll compressor defines a recess extending from one end of the slider block between a chamfer on an inner bore and a flat portion on an outer bore.

The inventive slider block has a cutout, and generally flat portion on an outer surface to allow for oil passage between the slider block and a boss extending from an orbiting scroll. A chamfer is formed on the inner bore of the slider block to provide clearance, and seat the slider block on a driveshaft for driving the orbiting scroll. A recess is formed in a wall between the flat portion on the outer surface and the chamfer on the inner bore. The width of the recess corresponds with the width of the flat portion and the depth corresponds to the depth of the chamfer. The recess eliminates the thin wall of the prior art, and reduces cracks originating from this area of the slider block.

These and other features of the present invention can be best understood from the following specification and drawings, the following of which is a brief description.

DETAILED DESCRIPTION OF THE PREFERRED EMBODIMENT

Figure 1:
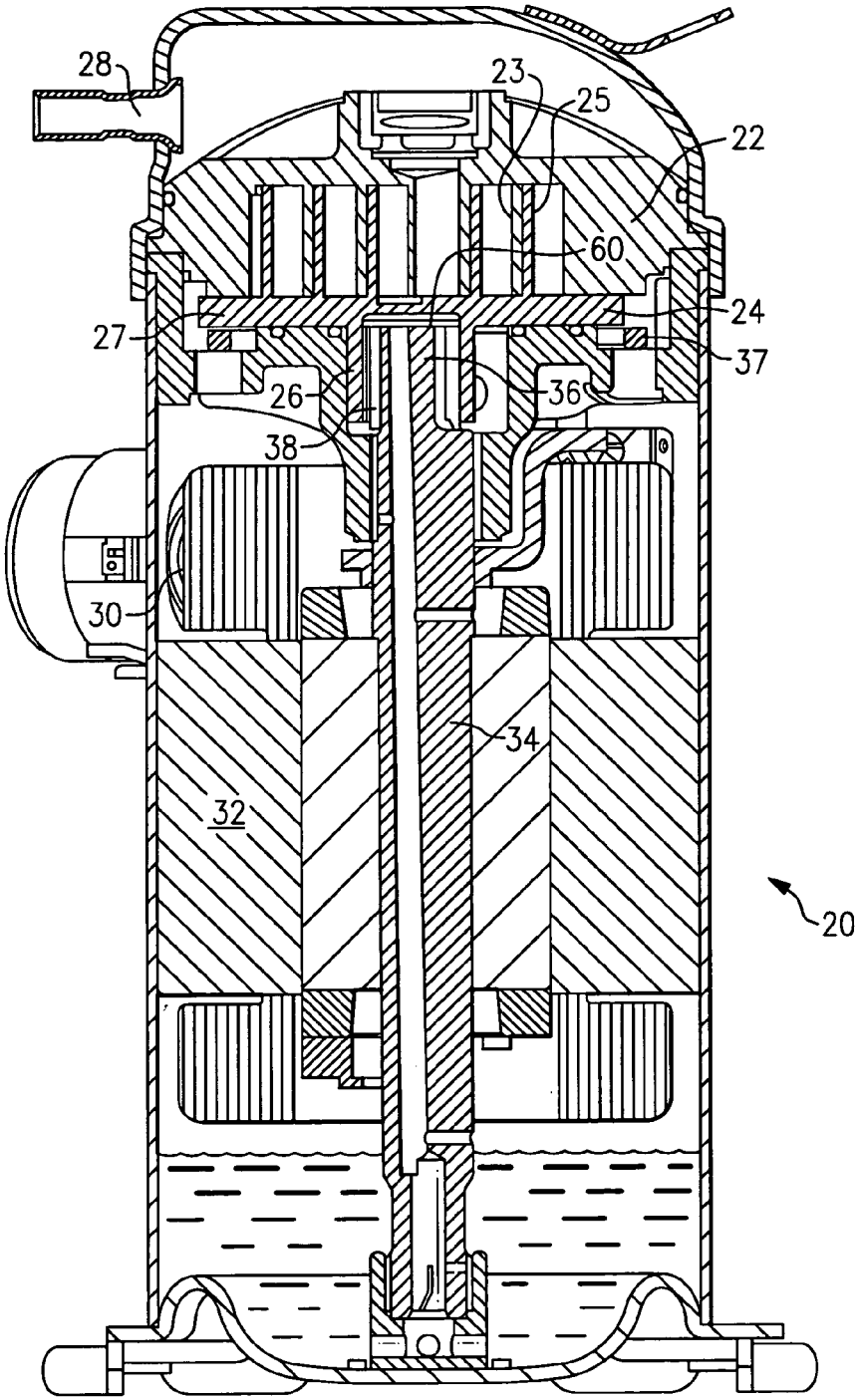
FIG.1 Prior Art
FIG. 1 shows a prior art scroll compressor.

A scroll compressor 20 is illustrated in FIG. 1, and is as known in the art. A non-orbiting scroll 22 has a spiral wrap 23 extending from a base. An orbiting scroll 24 has a spiral wrap 25 extending from its base 27. The orbiting scroll 24 further has a boss 26 extending from its base 27 in an opposed direction to the wrap 25.

Refrigerant is compressed in the compression chambers defined between the wraps 23 and 25 and delivered to a discharge port 28. Refrigerant enters the compressor housing through a section port 30.

A motor 32 drives a shaft 34 to rotate. The shaft 34 includes an eccentric pin 36 which is received within a slider block 38. The slider block sits within the boss 26, and between the boss and the eccentric pin 36. When the shaft 34 is caused to rotate, the eccentric pin moves the slider block 38, and hence the orbiting scroll 24 to orbit. An anti-rotation coupling 37 ensures that the orbiting scroll will not rotate, but instead orbits. An oil passage 33 in the shaft 34 delivers oil upwardly to lubricate between these connections.

Figure 2:
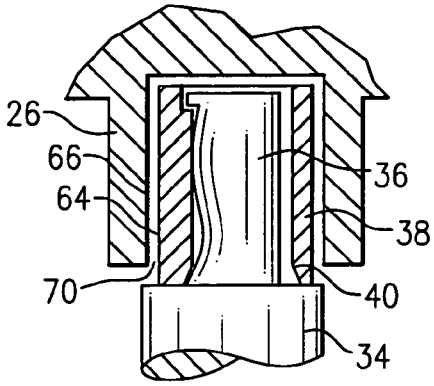
FIG.2 Prior Art
FIG. 2 shows a prior art slider block and eccentric pin.

FIG. 2 is an enlarged view of eccentric pin 36 and the slider block 38. The eccentric pin 36 is received within the slider block 38. The slider block 38 has a chamfer 40 at the bottom 42 to provide clearance, and allow the eccentric pin 36 to be fully seated against the shaft 34. A gap 70 is located between the outer surface 64 of the slider block 38 and the inner surface 66 of the boss 26. Oil passes through the gap 70 to lubricate the inner surface 66 of the boss 26.

Figure 3:
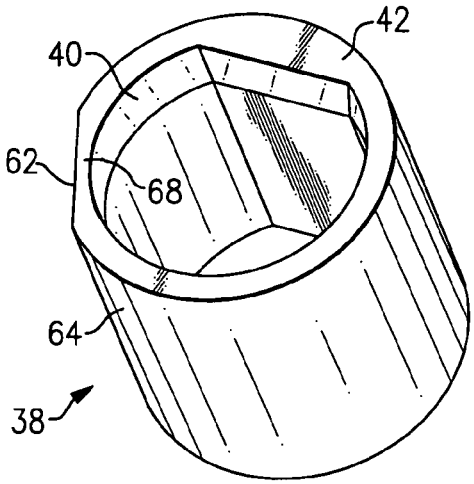
FIG.3 Prior Art
FIG. 3 is a perspective view of the prior art slider block.

FIG. 3 is a perspective view of the slider block 38 of the prior art. A flat portion 62 is formed on the outer surface 64 of the slider block 38 to create the gap 70 (shown in FIG. 2). Where the flat portion 62 is aligned with the chamfer 40, at the bottom 42 of the slider block, a thin wall portion 68 results. Cracks have sometimes originated in the thin wall portion 68 during manufacture, leading to an undesirably high scrap rate.

Figure 4:
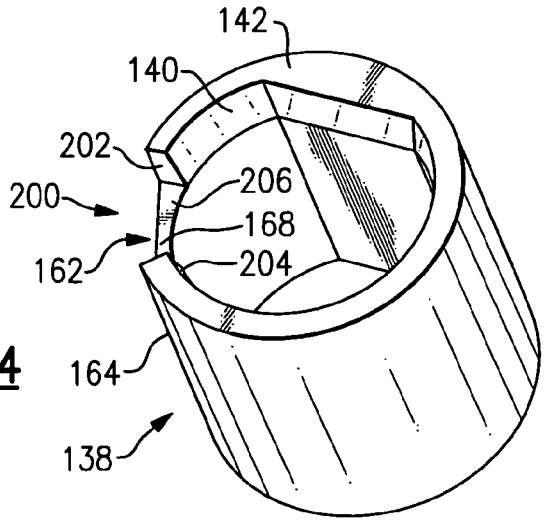
FIG. 4 is a perspective view of the inventive slider block.

FIG. 4 is a perspective view of the slider block 138 of the present invention. A recess 200 is formed in a wall 168 between a flat portion 162 on the outer surface 164 of the slider block 138 and a chamfer 140 inside. While portion 162 is shown as generally flat, its function is to provide clearance. Other shapes of cutouts may be utilized to provide the clearance. The circumferential width of the recess 200 corresponds with the width of the flat portion 162 on the outer surface 164 and the depth of the recess 200 corresponds to the depth of the chamfer 140. The recess 200 is defined by a first side 202 and a second side 204 extending from a bottom surface 142 of the slider block 138 to the end of the chamfer 140. A third side 206 of the recess 200 extends radially about the slider block 138 between the first side 202 and the second side 204. The first side 202, second side 204, and third side 206 have rounded corners with the wall 168 to prevent sharp edges which could lead to cracking.

As can be appreciated, moving upwardly along the chamfer 140, the wall becomes thicker. The depth of the recess 200, may alternately correspond to the point where the thickness of wall 168 is sufficient to withstand cracking. By removing the thin wall portion 68 of the prior art the high stress area has been eliminated and cracks originating from this area of the slider block 138 are reduced.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said spiral wraps of said first and second scroll members interfitting to define compression chambers;

a driveshaft for rotating about an axis driving said second scroll member to orbit relative to said first scroll member, said second scroll member having a downwardly extending boss, and said driveshaft having an eccentric pin extending upwardly into said boss; and a slider block received between said eccentric pin and said boss, wherein said slider block has a generally cylindrical outer surface with a cutout portion on said outer surface to allow oil passage along said slider block, and an inner bore receiving said eccentric pin, wherein a chamfer is formed at a first end on the inner bore spaced away from said base of said second scroll member, and said slider block having a recess formed into said slider block from said first end, and extending towards said base of said second scroll member for an axial length and a circumferential extent, and at least partially between said cutout portion and said chamfer.

2. The scroll compressor set forth in claim 1, wherein the axial length of said recess corresponds to an axial length of said chamfer.

3. The scroll compressor as set forth in claim 1, wherein said recess is defined by a first and second side extending from said first end of said slider block toward an end of said chamfer and a third side extending circumferentially about the slider block between the first side and the second side, and wherein the corners of the first side, the second side, and the third side are rounded.

4. The scroll compressor as set forth in claim 1, wherein the circumferential extent of said recess corresponds to a circumferential width of said cutout portion of said slider block.

5. The scroll compressor as set forth in claim 4, wherein said cutout portion is generally flat.

6. The scroll compressor as set forth in claim 1, wherein said cutout portion is generally flat.

* * * * *